United States Patent [19]

Conley et al.

[11] 4,102,149

[45] Jul. 25, 1978

[54] VARIABLE CAPACITY MULTIPLE COMPRESSOR REFRIGERATION SYSTEM

[75] Inventors: Thomas F. Conley, Staunton, Va.; Ernest F. Gylland, Jr., Seattle, Wash.; George E. Steele, Staunton, Va.

[73] Assignee: Westinghouse Electric Corp., Pittsburgh, Pa.

[21] Appl. No.: 789,909

[22] Filed: Apr. 22, 1977

[51] Int. Cl.[2] ..... F25B 41/00; F25B 31/00

[52] U.S. Cl. ..... 62/196 A; 62/468; 62/505; 62/510; 417/286

[58] Field of Search ..... 62/505, 510, 335, 468, 62/84, 196 A, 196 C; 417/372, 368, 286, 902

[56] References Cited

U.S. PATENT DOCUMENTS

| | | | |
|---|---|---|---|
| 2,253,623 | 8/1941 | Jordan | 62/510 |
| 3,358,466 | 12/1967 | Weller et al. | 62/505 |
| 3,621,670 | 11/1971 | Kinney | 62/510 |
| 3,785,169 | 1/1974 | Gylland | 62/510 |

*Primary Examiner*—John J. Vrablik
*Assistant Examiner*—Thomas I. Ross
*Attorney, Agent, or Firm*—E. C. Arenz

[57] ABSTRACT

The disclosed system includes first and second hermetic shell compressors, one of which always runs while the system is operating and includes unloading means for running at half load, and the other compressor operating at full load or not at all so that four operating capacity steps are available, both of the compressors having shells with suction gas inlets, oil equalizer line ports, and gas exchange line ports being identically sized and located with respect to each other so that standard compressors can be stocked and used in the multiple compressor system while the multiple compressor system is capable of being operated at the varying capacities.

4 Claims, 2 Drawing Figures

VARIABLE CAPACITY MULTIPLE COMPRESSOR REFRIGERATION SYSTEM

BACKGROUND OF THE INVENTION

1. Field of the Invention

The invention pertains to the art of multiple compressor refrigeration systems of the type in which one of the compressors at least is subject to individual unloading.

2. Description of the Prior Art

While parallelly arranged compressors have been taught in the prior art as in U.S. Pat. Nos. 3,503,223, 3,386,262 and 2,253,623 for example, so far as we are aware they have not been used to any appreciable extent in the form of hermetic shell type compressors in which one of the two is subject to being partly unloaded so that the capacity of the system can be varied through four operating steps.

U.S. Pat. Nos. 3,785,169 and 3,775,995, assigned to the same assignee as this application, disclose multiple hermetic shell compressors, one of which is part unloading to obtain the four capacity steps, arranged in a way that all of the suction gas is returned first to the part unloading compressor and then passing part of the suction gas through the shell of the first compressor to the shell of the second, non-unloading compressor. This arrangement is successful in its commercial usage and is believed to be the only arrangement in which dual hermetic shell compressors, of which one is part unloading, satisfactorily provide the four operating capacities without unduly restricting the operating limits in terms of the saturated discharge temperatures.

The problem of the limited saturated discharge temperature at operations of less than full capacity stems from any reciprocating compressor which is unloaded tending to run hotter than in a fully loaded condition. This is because of the recirculation of the hot gas within the partly unloaded compressor. A two compressor arrangement in which one can be unloaded to half capacity while the other compressor runs at full load or not at all permits the four capacity steps of 100%, 75%, 50% and 25%. At the 75% level, the problem is probably at its worst in the sense that there is a reasonably high system load with high condenser temperatures and pressures. At the 25% system capacity level, even though the first or lead compressor is operating half unloaded, the lower system load and lower condenser temperatures and pressures tend to alleviate the problem. With the series or tandem arrangement of the last two noted patents, when the system is operating at the 75% capacity level the second or lag compressor is forced to receive its suction gas through the shell of the part unloaded first or lead compressor so that the heat generated by the bypassing of the gas in the lead compressor is dissipated to a degree by the flow of gas entering the fully loaded lag compressor. Also in this situation the lag compressor determines the saturated discharge condition limit for any given saturated suction condition, since its entering suction gas is receiving additional superheat from the unloaded compressor. From the foregoing it will be understood why the suction gas return arrangement of the last two noted patents results in the satisfactory operation in the various capacity steps.

While that arrangement is satisfactory from an operating standpoint, it is not wholly satisfactory with respect to requiring the use of two compressors which have different constructions, and in particular the use of a lead compressor which is not standard with respect to compressors which are to be used singly. Compressors of the type and size used in this invention are manufactured for use either singly, or as one of two compressors in a multiple system. Compressors of a given size will typically be built both in a non-unloading version, as well as an unloading version, since the customer of a single compressor of a given size may desire either one or the other, depending upon the system load characteristics. The unloading compressors are more expensive than the non-unloading compressor because of the additional mechanisms involved. Accordingly, with the arrangements of the last two noted patents of our assignee, the lead compressor is a compressor of a special version and is usable only as a lead compressor in the multiple compressor system of the patents. This is because it is built with the enlarged suction line entry port, and with the large suction gas exit port at the opposite side of the shell. Thus if a customer wishes to replace the lead compressor in that arrangement, he must have precisely that version of compressor and may not use a standard unloading type compressor of that particular size which is manufactured for use in a single compressor system. Or if a customer wishes to buy an unloading compressor of that particular size for use in a single compressor system, the compressor of that size with the enlarged suction gas inlet and the suction gas exit port is not considered as satisfactory.

Therefore, the problem with which this invention is concerned is to provide an arrangement in which the lead compressor for the multiple compressor system can be a standard unloading type compressor but in which the advantages of the tandem system of compressors is still basically available.

SUMMARY OF THE INVENTION

In accordance with the invention, the variable capacity multiple compressor refrigeration system is of the type having a first hermetic shell compressor which always runs while the system is operating and includes unloading means for running at half load, and a second hermetic shell compressor which operates at full load or not at all so that four operating capacities are available from the system. Each of the compressors has a shell with suction gas inlets identically sized and located on the upper portion of the shells, with oil equalizing line ports identically sized and located on the lower portions of the shells near the level of the normal oil level during operation, and with gas exchange line ports identically sized and located in the upper portion of the shells. First suction conduit means connect the inlet port of the first compressor to the system suction gas return line which has a larger diameter than the diameter of said inlet ports. Second suction conduit means connect the inlet port of the second compressor to the system suction gas return line at a point upstream of the connection between the first suction conduit means and the system suction gas return line. An oil equalizer line connects the oil equalizing line ports, and a gas exchange line connects the gas exchange line ports so that during the operation of the first compressor partly unloaded with the second compressor running at full load, cooling of the first compressor is obtained by the passage of suction gas through the gas exchange line from the shell of the first compressor to the shell of the second compressor.

DRAWING DESCRIPTION

FIG. 1 is a partly broken, partly schematic top view of the compressors arranged according to the invention; and FIG. 2 is a side view of the arrangement of FIG. 1.

DESCRIPTION OF THE PREFERRED EMBODIMENT

Figure 2:
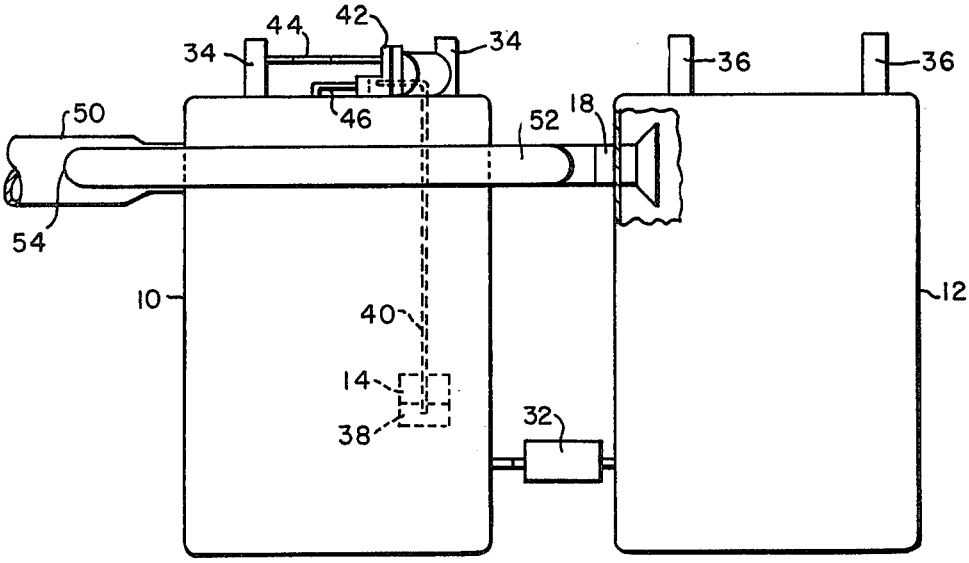

Referring to the drawing, both the first (lead) compressor 10 and the second (lag) compressor 12 are hermetic shell refrigerant compressors having multiple cylinders, such as 4 to 6 which are not shown except for a single cylinder 14 diagrammatically shown in dash lines in FIG. 2. The suction inlet port 16 of the first cylinder is sized the same as a standard compressor typically used alone in a single compressor system. The suction inlet port 18 for the second compressor is identically sized and located at the same place in the upper portion of the shell as the corresponding suction inlet port 16 of the first compressor. The oil equalizer line ports 20 and 22 of the first and second compressors, respectively, are also identically sized and located on the lower portions of the two compressor shells at a level near the normal oil level occurring when both compressors are running. Each of the compressors also includes in the upper portion of its shell gas exchange line ports 24 and 26 again identically sized and located on the shells. The gas exchange line ports are connected by the gas exchange line 28, and the oil equalizing line ports are connected by the oil equalizer line 30 which includes a filter 32 at an intermediate location along the line.

Figure 1:
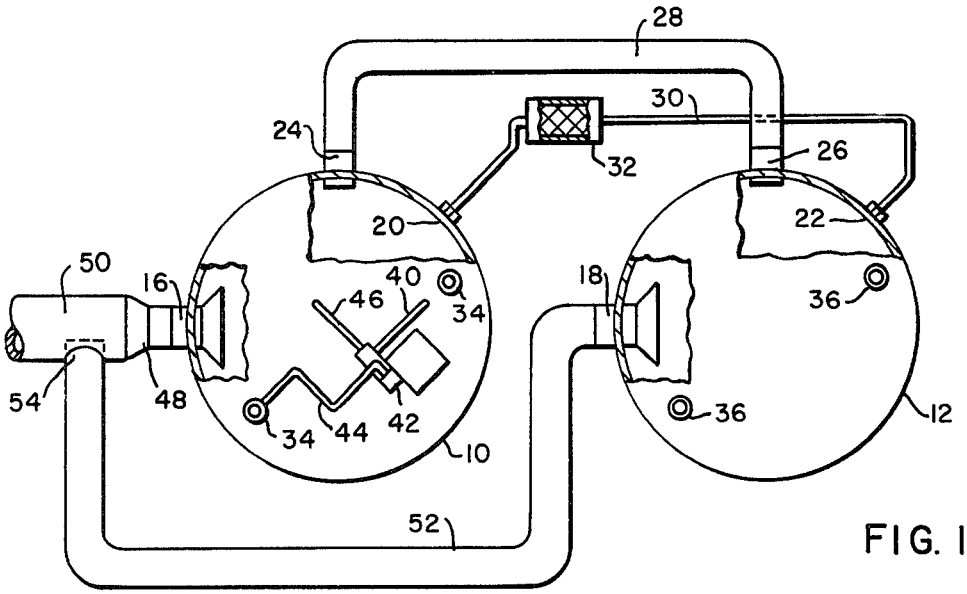

Each of the compressors is also provided with two discharge tube ports, those of compressor 10 carrying the numeral 34 and those of compressor 12 carrying the numeral 36. Since the lead compressor 10 is of the part unloading type, an unloading mechanism is provided which may be of any conventional form. In the form diagrammatically illustrated, the unloadable cylinders of the compressor are equipped with spring balanced piston type cylinder unloaders which are actuated by discharge gas pressure for unloaded starting and for capacity reduction. This is accomplished by the unloading mechanism 38 (diagrammatically illustrated in FIG. 2) which is connected by a line 40 to a solenoid operated three-way valve 42 (FIG. 1) on the top of the shell of the first compressor. This valve 42 also has a line 44 connected to the discharge line from the non-unloading cylinders capable of providing the high pressure gas for acuating the unloading mechanism 38, and also a line 46 which provides for the gas bleed to suction side in the compressor in the unloaded condition of the compressor. The unloading arrangement for the compressor 10 is conventional for purposes of this patent application.

In the refrigeration system according to the invention, the standard size suction inlet port 16 of the lead compressor 10 is connected through a transition fitting 48 to the significantly larger diameter system suction gas return line 50. The suction inlet port 18 of the lag compressor 12 is connected by the suction conduit 52, of about the same diameter as the suction inlet port 16 of the lead compressor, to the main system suction gas return line at a point upstream from the transition 48. The connection 54 is of a form according to conventional piping practices so that more than 50% of the oil return entrained in the refrigerant is received by the lead compressor 10.

Operation

The lead compressor 10 can operate at full load or at half load while the lag compressor 12 operates at either full load or not at all. This provides four equal capacity steps for the system of 100% down to 25%. As noted before, at the 75% capacity step when the lead compressor is unloaded and the lag compressor is operating fully loaded the lead compressor tends to run hotter than when it is not partly unloaded. Since with both compressors running the suction pressure in the lag compressor is always less than in the lead compressor because of the pressure drop through the suction conduit 52 and the gas exchange line 28, additional cooling of the lead compressor 10 is obtained by that suction gas which flows through the shell of the lead compressor and through the gas exchange line 28 to the lag compressor. Thus with this arrangement, as with the arrangement of the noted patents of our assignee, the saturated discharge temperature is not limited to the degrees it would be in strict parallel compressor operation without the gas exchange line.

When the lead compressor is operating alone, as in the 50 and 25% capacity steps, additional suction gas is introduced to the lead compressor in a circuit which includes the suction conduit 52, and then both the gas exchange line 28 and the oil equalizer line 30. To prevent the flow of the cool suction gas in the vicinity of the lag compressor's oil sump, and to thus maximize the effectiveness of an oil sump heater the oil equalizer line 30 is significantly smaller than the gas exchange line 28. However, with the flow direction under these conditions of only the lead compressor operating, the pressure difference in the two shells results in the transfer of excess oil (that oil normally above the equalizer line) from the sump of lag compressor 12 to the sump of lead compressor 10. This assures that the lead compressor will have a greater than normal oil supply during these capacity steps when there is the possibility that oil is more easily trapped in an improperly piped refrigeration system. By virtue of the oil equalizer line being relatively small, this results also in lower oil circulation between the compressors in the capacity steps of 100% and 75%.

The filter 32 in the oil equalizer line 30 prevents cross sump contaminated regardless of flow direction, so that if either compressor has contaminated oil due to a burnout or bearing failure, the foreign material is prevented from entering the other compressor.

Of course the main advantage of the disclosed arrangement relative to the tandem or series prior art arrangement is that the compressors used in the present arrangement may be of the standard character and form of the type which may be used in single compressor systems. In that connection, the gas exchanger ports 24 and 26 may constitute the process tube ports conventionally found with such compressors through which charging and other operations are performed. In the standard compressor, the process tubes constitute a stub which has been crimped and then brazed for a seal. If this process stub is to double as a gas exchange line port, the crimped part is simply severed and the gas exchange line 28 is brazed to that port.

We claim:

1. In a variable capacity multiple compressor refrigeration system of the type having a first hermetic compressor which always runs while the system is operating and includes unloading means for running at half load, and a second hermetic shell compressor which operates at full load or not at all, so that four operating capacities are available from the system:

each of the compressors having shells with suction gas inlets identically sized and located on the upper portion of the shells, with oil equalizer line ports identically sized and located on the lower portion of the shells near the level of the normal oil level during operation, and with gas exchange line ports identically sized and located on the upper portion of the shells;

first suction conduit means for connecting the inlet port of said first compressor to the system suction gas return line, the suction gas return line having a larger diameter than the diameter of said inlet ports;

second suction conduit means connecting the inlet port of said second compressor to the system suction gas return line;

an oil equalizer line connecting said oil equalizer line ports;

a gas exchange line connecting said gas exchange line ports, said gas exchange line functioning to pass suction gas from the shell of said first compressor to said second compressor when said second compressor is running, and said first compressor is running in an unloaded condition, to promote cooling of said first compressor in its unloaded condition.

2. In the system of claim 1 wherein:

said connection of said second suction conduit means to the system suction gas return line is of a character to cause the return of more than half of the oil in the refrigerant in the suction gas return line to pass into the first compressor.

3. In a system according to claim 1 wherein:

said oil equalizer line includes filter means therein.

4. In a system according to claim 1 wherein:

said oil equalizer line presents significantly greater resistance to suction gas flow therethrough relative to the resistance of said gas exchange line so that when said first compressor operates alone, the flow of cool suction gas from the lower portion of said second compressor to said first compressor is relatively small as compared to the flow of suction gas through said gas exchange line.

* * * * *